US005176611A

United States Patent [19]

VerMehren

[11] Patent Number: 5,176,611

[45] Date of Patent: Jan. 5, 1993

[54] SEALING ASSEMBLY ATTACHMENT AND METHOD

[76] Inventor: H. Richard VerMehren, 3865 N. Palafox St., Pensacola, Fla. 32505

[21] Appl. No.: 823,707

[22] Filed: Jan. 21, 1992

[51] Int. Cl.[5] ..... B31B 21/26; B31B 21/90

[52] U.S. Cl. ..... 493/213; 493/220; 493/963

[58] Field of Search ..... 493/213, 214, 220, 245, 493/424, 923, 927, 962

[56] References Cited

U.S. PATENT DOCUMENTS

| | | | |
|---|---|---|---|
| 3,510,052 | 5/1970 | Ruda | 493/214 |
| 3,604,318 | 9/1971 | Winkler | 93/74 |
| 3,733,982 | 5/1973 | Manolis | 493/212 |
| 3,906,844 | 9/1975 | Gougeon | 493/347 |
| 4,126,948 | 11/1978 | VerMehren | 34/150 |
| 4,138,933 | 2/1979 | Helm | 93/61 R |
| 5,045,040 | 9/1991 | Vetter | 493/194 |

*Primary Examiner*—William E. Terrell

*Attorney, Agent, or Firm*—Heller & Kepler

[57] ABSTRACT

A sealing assembly attachment, for use in preparing envelopes which will apply a gum to a top flap, place a piece of release paper over the gummed flap, fold and crease the top flap and deliver the envelope to be stacked and counted. The sealing assembly attachment generally consists of a transfer cylinder to transfer envelopes into the sealing assembly attachment, a vacuum cylinder within the sealing assembly attachment to transport envelopes from the transfer cylinder and through the sealing assembly attachment, a gum pattern applicator to apply gum to a top flap of the envelopes while being transferred by the vacuum cylinder, a release paper applicator after the gum pattern applicator to place release paper over the gum applied to the top flap, a flap fold cylinder used in cooperation with the vacuum cylinder to fold and crease the top flap; and a delivery disk to transfer the envelope from the sealing assembly attachment to a delivery table to be stacked.

26 Claims, 7 Drawing Sheets

SEALING ASSEMBLY ATTACHMENT AND METHOD

BACKGROUND OF THE INVENTION

The present invention relates in general to a sealing assembly attachment and method, and more particularly, to an apparatus which attaches to an apparatus for processing envelopes which applies a gum and release paper to a flap on an envelope, folds the envelope flap and deliver the completed envelopes for counting and stacking.

The conventional attachment to provide gum to a flap of an envelope and fold the flap are typically provided as two stations of a number of stations in an envelope processing apparatus or other continuous processing apparatus. In the conventional envelope processing apparatus there are a number of stations which together form a substantially continuously operating device for applying gum, creasing flaps for folds, folding flaps, counting and stacking the completed envelopes.

In a conventional apparatus, for example as depicted in FIG. 1, a stack of blanks are placed in a feeder unit. The blanks are peeled from the feeder unit one at a time by a feed mechanism and placed on a conveyer system. The conveyer system carries generally, evenly overlapped blanks over to a gummer roller apparatus which applies gum to the cover flap.

The blanks are separated and carried through a dryer unit to dry the gum. The blanks are separated, aligned and properly positioned and timed for the next operation. A window patch unit places a strip of gum around the window opening of the blank. A single window patch of glassine-type paper or other transparent material has been cut from a roll and transferred onto a suction plate of a patch cylinder shoe. The patch cylinder shoe rotates and as the blanks pass take each patch down onto the blanks and over the gum strip around the window opening.

The blanks are aligned, positioned and timed for proper registration with a scorer unit. The scorer unit scores the blanks with four grooves from corner to corner forming a square or rectangle. These grooves establish the lines where the blank will be folded.

The grooved blanks pass through a folding device to force the side flaps to fold over the blank. The blanks with the folded sides are carried under a side gummer die and receive a strip of gum along the bottom edges of the folded side flaps.

A bottom flap folder folds the bottom flap over and into contact with the gummed side flaps. A top flap folder folds and creases the top flap and completes one envelope. This procedure is repeated.

The conveyer system carries the completed envelopes to a delivery table where the finished envelopes are stacked and counted.

Conventional envelope processing equipment typically does not provide the desired operation in order to make an envelope with self adhesive strips covered with release paper.

Overcoming this drawback has resulted, for example, with the need to modify a conventional machine, for example, by replacing a drying station is replaced with a release paper press to place the release paper over the gummed flap. In operation, the modified machine has a further drawback of slower operation and an unfortunate tendency for the release paper to get jammed somewhere along the conveying system.

Existing machines also have a drawback related to any changeover from a machine set up to make the envelopes and a machine that operates with pre-made envelopes. With the latter there is no need for either a drying station or an initial gumming station. The conventional machinery cannot normally operate as fast or as efficient as an envelope processing apparatus as described and claimed herein.

In one preferred embodiment of the present invention, the sealing assembly attachment is provided as a separate unit and includes a top flap folder and a stacking and counting station.

SUMMARY OF THE INVENTION

Accordingly, it is an object of the present invention to provide a sealing assembly attachment and method of using the attachment that is adapted for use in envelope manufacturing equipment or as a separate unit for attachment to another piece of equipment. In both applications the sealing assembly is used to provide for applying one or more adhesive sealing strips to an envelope or envelope flap and then apply one or more release sheets as required over the adhesive sealing strip applied to the envelope.

Another object of the present invention is to provide a sealing assembly attachment and method that is adapted for gumming a top flap, placing a piece of release paper over the gummed flap, folding and creasing the top flap, and incorporating conventional stacking and counting equipment. the envelopes. The sealing assembly attachment of this invention can be used as either a stand alone station or incorporated into a larger envelope processing apparatus to increase operational speed and efficiency.

A further object of the present invention is to provide a sealing assembly attachment that is constructed to provide a more continuous and uniform adhesive transfer and placement of release paper over the gummed flap or flaps.

Still another object of the present invention is to provide a sealing assembly attachment that is adapted for use with existing equipment. The attachment of this invention may be incorporated into existing equipment with only minor timing modifications to ensure that the timing of the gumming and release paper placement operations are properly timed to the existing equipment.

Still a further object of the present invention is to provide a sealing assembly and attachment that will fold and crease a top flap once a sheet of release paper is applied over a gummed portion of the flap.

Another object of the present invention is to provide a sealing assembly attachment that is readily useable with a conventional envelope stacking and counting station as they come out of the attachment and onto a table.

A further object of the present invention is to provide a sealing assembly attachment which can perform several function and can be used in place of several other station within an otherwise conventional envelope processing apparatus.

Still another object of the present invention is to provide a sealing assembly attachment and method that reduces the number of steps or operations as does a conventional machine. The attachment can result in a shorter length for the conveyer system.

To accomplish the foregoing and other objects of this invention there is provided a sealing assembly attachment and method, for use in preparing envelopes which will apply a gum to a top flap of an envelope, place a piece of release paper over the gummed flap, fold and crease the top flap and deliver the finished envelope to be stacked and counted.

The sealing assembly attachment comprises means for transfer the envelopes, means for applying a gum or latex, means for applying a release paper member or equivalent, means for folding one or more flaps, and means for delivering an envelope or envelopes processed by the machine and method of the present invention for counting and stacking by conventional devices.

In one preferred embodiment of the present invention, there is provided a transfer cylinder, a vacuum cylinder, a gum applicator, a release paper applicator, a flap fold cylinder, and delivery disks.

The transfer cylinder transfers envelopes into the sealing assembly attachment. The vacuum cylinder provides for the desired envelope transfer in the preferred embodiment described herein.

The gum pattern applicator applies gum to the top flap of the envelopes while being transported by the vacuum cylinder. The release paper applicator is located after the gum pattern applicator and places release paper over the gum applied to the top flap.

The flap fold cylinder is used in cooperation with the vacuum cylinder to fold and crease the top flap. The delivery means is used to transfer the envelope from the pull and press attachment. A drive means controls the speed and direction of rotation of the transfer cylinder, vacuum cylinder, gum pattern applicator, release paper applicator, and flap fold cylinder.

In the embodiment described herein, the transfer cylinder, vacuum cylinder and flap fold are vacuum cylinders. A cylinder has an external cylindrical surface with an arrangement of vacuum holes. When a vacuum is supplied, the vacuum through the holes create a pressure difference that holds an envelope or envelope flap to the outer surface of the respective cylinder and the respective envelope rotates with the cylinder.

An vacuum valve within its respective cylinder acts to control the vacuum applied to the envelope or envelope flap.

The means for attaching a vacuum means and supporting the cylinders, in the preferred embodiment, generally consist of two shafts, one a fixed shaft and the other rotatable shaft. The rotatable shaft is further divided into a first and a second component.

In one preferred embodiment, the first component is solid and is attached to the center of one end on each of the cylinders. The second component is attached to the center of the other end of each of the cylinders. Suitable bearings are provided and attached to the rotatable shafts to support the cylinders and to allow cylinder rotation while maintaining a desired vacuum. The drive means is also attached to the rotatable shafts.

The fixed shaft is generally hollow and has a first and a second end.

The vacuum is applied to the first compartment such that as the cylinders rotate only the vacuum holes on the first compartment are supplied with a vacuum for holding an envelope securely to the external cylindrical surface of the cylinders. The second compartment is maintained at atmospheric pressure so that an envelope will be released from the cylindrical surface as the cylinder rotates to expose the vacuum holes to the second compartment.

The gum pattern applicator, in the preferred embodiment, contains a gum pattern applicator roll and generally is a part of a gummer roll apparatus which may be a separate attachment to this attachment. The gum pattern applicator is timed to the delivery of an envelope on the vacuum cylinder to apply gum to top flap of the envelope as the envelope rotates on the vacuum cylinder.

The release paper applicator generally consists of a release paper carrier cylinder, a rotary knife cylinder, a stationary knife and a roll of release paper. The release paper carrier cylinder applies a piece of release paper on the gummed flap as the envelope on the vacuum cylinder rotates past the release paper carrier cylinder. The release paper carrier cylinder receives the piece of release paper from the rotary knife cylinder.

The piece of release paper is cut by the stationary knife as the rotary knife cylinder rotates and pulls release paper from the roll of release paper.

In a preferred embodiment, the release paper carrier cylinder is a cylinder and has an external cylindrical surface with an arrangement of vacuum holes. The vacuum holes attracting and holding the piece of release paper to the cylindrical surface of the release paper carrier cylinder as the cylinder rotates. An vacuum valve, as described above, controls which vacuum holes are under the influence of a vacuum supplied to the cylinder.

These and other objects and features of the present invention will be better understood and appreciated from the following detailed description of the preferred embodiments thereof, selected for purposes of illustration and shown in the accompanying drawings.

DETAILED DESCRIPTION

Figure 1A:
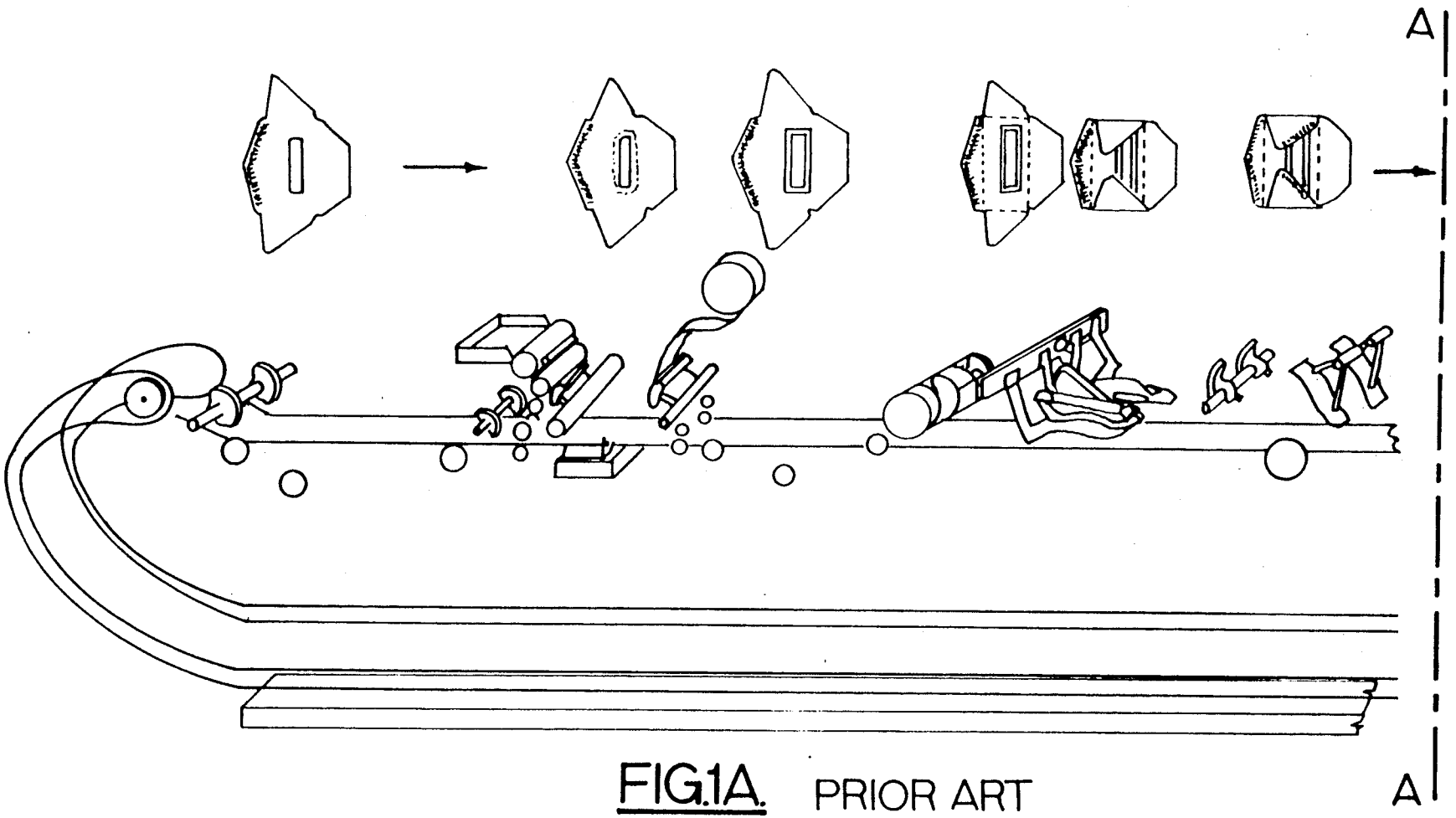
FIG.1A. PRIOR ART
FIGS. 1A and 1B combine along line A—A to illustrate one conventional envelope processing machine.

Referring now to the drawings there are shown the preferred embodiments for the sealing assembly attachment 10 of this invention. The sealing assembly attachment is described in connection with a piece of equipment used for preparing envelopes and will apply a gum to a top flap, place a piece of release paper over the gummed flap, fold and crease the top flap and deliver the envelope to be stacked and counted.

The sealing assembly attachment of the present invention is particularly adapted for incorporating into a larger apparatus which, when combined into a functioning unit, and is characterized as being able to perform all of the desired operations on an envelope blank to have a finished envelope as an end product. This can be in an embodiment incorporated into an existing piece of equipment or as an attachment to an existing piece of equipment.

A conventional piece of equipment, which is prior art, is illustrated in FIG. 1, wherein it is depicted schematically that an envelope blank under goes several operations from one station to the next, resulting in a completed envelope when done.

Preferred embodiments of the sealing assembly and assembly attachment of the present invention and method of operation will now be described.

Figure 5:
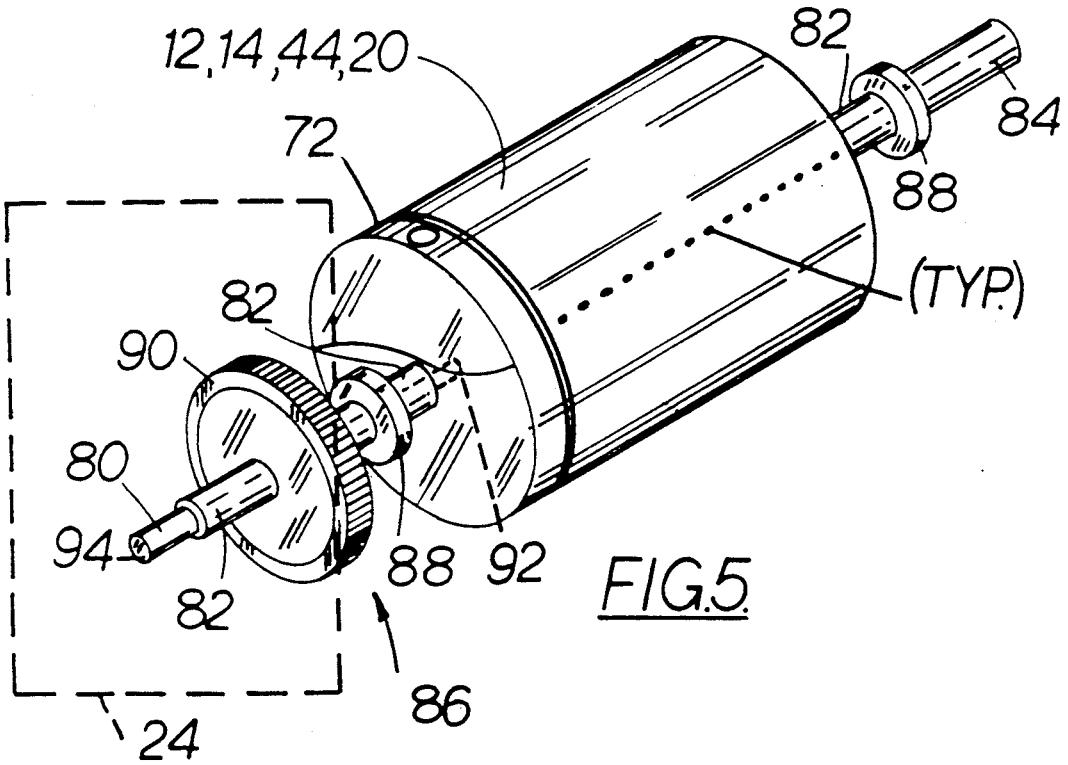
FIG. 5 is a perspective view of a vacuum cylinder depicting one embodiment of a supporting and an attachment for providing a vacuum.

Generally, in one of the preferred embodiments, the sealing assembly attachment 10 of this invention, consists of a transfer cylinder 12, a vacuum cylinder 14, a gum pattern application means 16, a release paper application means 18, a flap fold cylinder 20, delivery disks 22 and a conventional drive means 24 illustrated schematically in FIG. 5.

The transfer cylinder 12 introduces envelopes 26 into the sealing assembly attachment 10 from a folding machine. It will be understood that the folding machine may be of a variety of conventional folding machines presently available. The envelopes 26 enter the sealing assembly attachment 10 in such a position that the envelopes opening is facing inward towards the external cylindrical surface 28 with the bottom of the body 38 being first.

The transfer cylinder 12 can be a hollow cylinder having an external cylindrical surface 28 with an arrangement of vacuum holes 30. The vacuum holes 30 are generally arranged in a row or multiple rows of equally diameter holes. A vacuum applied through a vacuum valve associated with each of the transfer cylinders, including cylinder 12, acts upon the vacuum holes 30 to attract and hold an envelope 30 to the external cylindrical surface 28 as the transfer cylinder 12 rotates.

It will be understood that the hole pattern may vary depending upon the application with which the invention is used. A simple system for arranging the vacuum holes calls for a pattern of holes with the holes not required covered with tape or other means to block them off from active use.

The rows of vacuum holes 30 are spaced in accordance with the size of the envelope 26 and the feeding rate of the envelopes into the sealing assembly attachment 10. The spacing of holes 30 may be varied for a particular type or style of envelope as required. It will be understood that the vacuum cylinders may be arranged for removal and replacement with cylinders as the job being done is changed between envelope types.

The vacuum cylinder 14 is located within the sealing assembly attachment 10 near the transfer cylinder 12 to transfer envelopes 26 from the transfer cylinder 12 and to transport the envelopes 26 through the sealing assembly attachment 10. The envelopes 26 are attracted to and held on the external cylindrical surface 32 of the vacuum cylinder 14 with the envelope's opening facing outward and in a position with the body 38 being ahead of the top flap 36.

As an envelope 26 rotates on the transfer cylinder toward the vacuum cylinder 14 a vacuum acting on the vacuum holes 30 is terminated thereby releasing the envelope 26 so that the vacuum acting on the vacuum holes 34 on the vacuum cylinder 14 attract the envelope 26. This action effectively transfers the envelope and flips it over so the envelope opening is now facing outward.

The vacuum cylinder 14 can be a cylinder having an external cylindrical surface 32 with an arrangement of vacuum holes 34. The vacuum holes 34 attract the envelopes from the transfer cylinder 12 and holds the envelope 26 to the external cylindrical surface 32 as the vacuum cylinder 14 rotates. The arrangement of vacuum holes 34 on the vacuum cylinder 14 consists of at least one set of two rows. The first row attracts and hold the body 38 of the envelope 26 and the second row attracts and holds the top flap 36 of the envelope 26.

A gum pattern application means 16 applies gum to the top flap 26 of the envelopes 26 while being transferred by the vacuum cylinder 14. In the preferred embodiment, the gum application means 16 comprises a gummer roll apparatus. The gummer roll apparatus is timed to the delivery of an envelope 26 and having a gum application roll 40 for applying the gum to the top flap 36 as the envelope 26 rotates on the vacuum cylinder 14.

The size and shape and the performance of the means 16, hereinafter gum box, will be provided as required for applying the desired gum or adhesive, for example, a latex known to provide the desired results.

The gum application roll 40 is typically a cylinder having a conventional gummer pad 42. The gummer pad 42 is in the shape of the pattern of the flap 36 on the envelope 26. This provides for a uniform application of gum along the edge of the flap 36. The gum roll apparatus supplies a uniform thickness of gum to the gummer pad 42.

The release paper application means 18 is located after the gum pattern application means 14. The release paper application means 18 places a piece or patch of release paper over the gum applied to the top flap 36.

The release paper application means 18, in the preferred embodiment, generally consists of a release paper carrier cylinder 44, a rotary knife cylinder 46, a stationary knife 48 and a roll of release paper 50. The release paper carrier cylinder 44 applies the piece of release paper on the top flap 36 as the envelope 26 rotates past the release paper carrier cylinder 44 on the vacuum cylinder 14 after the top flap 36 has been gummed by the gum application means 18.

The release paper carrier cylinder 44 receives the piece of release paper delivered from the rotary knife cylinder 46. The piece of release paper is cut by the stationary knife 48 as the rotary knife cylinder 46 rotates and pulls release paper from the roll of release paper.

The release paper carrier cylinder 44 is a cylinder and has an external cylindrical surface 52 with an arrangement of vacuum holes 54. The vacuum holes 54 consist of rows of equal diameter holes. A vacuum within the release paper carrier cylinder 44 acting upon the vacuum holes 54 attracts and holds the piece of release paper to the external cylindrical surface 52 as the release paper carrier cylinder 44 rotates.

As the piece of release paper is applied to the gummed top flap 36 the vacuum acting upon the vacuum holes 54 is terminated thereby releasing the piece of release paper.

The flap fold cylinder 20 is used in cooperation with the vacuum cylinder 14 to fold and crease the top flap 36. The flap fold cylinder 20 is a hollow cylinder having an external cylindrical surface 56 with an arrangement of vacuum holes 58. The vacuum hole 58 typically consist of a row or multiple rows of equal diameter holes. A vacuum within the flap fold cylinder 20 acting upon the vacuum holes 58 attracts and holds the envelope 26 to the external cylindrical surface 56 as the flap fold cylinder 20 rotates.

The flap fold cylinder 20 is located after the release paper application means 18. As the envelope 26 on the vacuum cylinder 14 rotates past the release paper application means 18 the vacuum acting upon the first row of vacuum holes 34 terminates. This releases the body 38 of envelope 26 from the external cylindrical surface 32 of the vacuum cylinder 14.

Rotation of the respective cylinder acts to move the body 38 of envelope 26 forces the bottom edge of the body 38 outward away from the vacuum cylinder 14. The top flap 36 of envelopes remains held to the vacuum cylinder 14 by the second row of vacuum holes 34. This action begins the folding operation.

The vacuum within the flap fold cylinder 20 acting upon vacuum holes 58 then attracts the body 38 on the opposite side of the envelope 26. As the vacuum cylinder 14 and the flap fold cylinder 20 rotate the folding operation is completed and the fold is creased as the envelope 26 passes through the contacting external cylindrical surfaces 32 and 56 of the vacuum cylinder 14 and the flap fold cylinder 20. The vacuum within the vacuum cylinder 14 acting upon the second row of vacuum holes 34 is then terminated releasing the top flap 36.

The completed envelope 26 is fed into a delivery means 22 by the flap fold cylinder 20. As the completed envelope 26 enters the delivery means 22 the vacuum within the flap fold cylinder 20 acting upon the vacuum holes 58 is terminated thereby releasing the completed envelope 26 from the flap fold cylinder 20.

The delivery means 22, in a preferred embodiment, consists of conventional delivery disks 60. The delivery disks generally being rotatable about a shaft 62 and having spiral slots 64 for receiving completed envelopes 26 from the flap fold cylinder 20. The delivery disks 60 deliver the completed envelopes 26 to a delivery table 66. The delivery disks 66 may be attached to a counting means in which the completed envelopes are counted prior to stacking on the delivery table 66.

A delivery disk stripper 68 is provided and acts to force the completed envelopes 26 from the delivery disk 60 as the delivery disks 60 rotate. This forces the completed envelopes 26 to the delivery table 66. A delivery belt 70 may be used on the delivery table 66 for stacking and preparation for packaging the completed envelopes.

One particular arrangement of a vacuum cylinder will now be described with respect to the present invention. It will be understood that other vacuum transfer cylinders or their equivalence can be substituted.

A valve means 72 controls the vacuum within the cylinders. In a preferred embodiment, the valve means is a vacuum valve that is stationary relative to the associated cylinder. A suitable bearing or bushing allows the shaft supporting its respective cylinder for rotation to rotate while the vacuum valve 72 remains stationary.

Figure 4B:
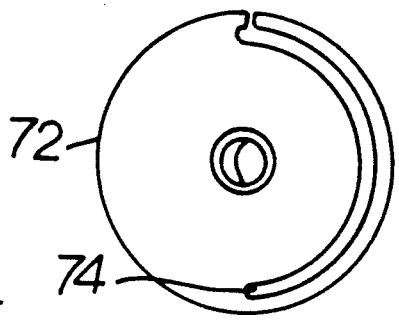
FIGS. 4B–4E is a typical side cross-sectional view of the vacuum valve depicting an internal groove in communication with a vacuum supply, a vacuum entrance, bearing hole, surface vacuum holes, vacuum hole through cylinder, and gear.
Figure 4D:
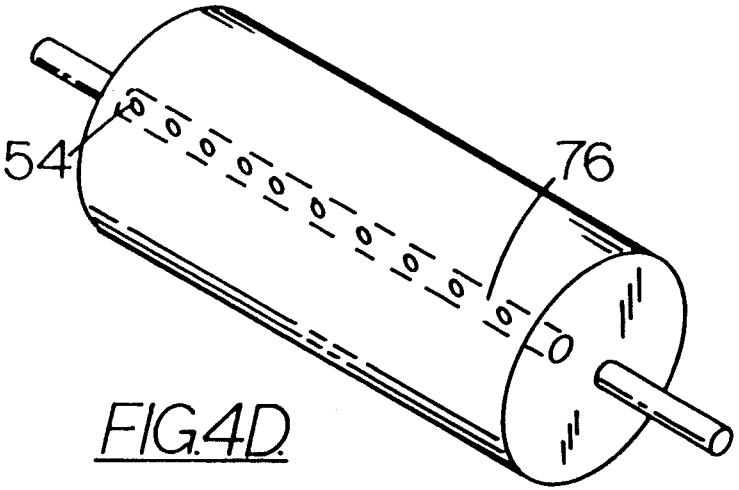
Figure 4E:
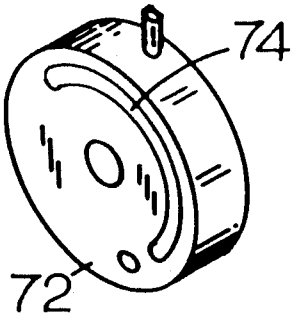
Figure 4C:
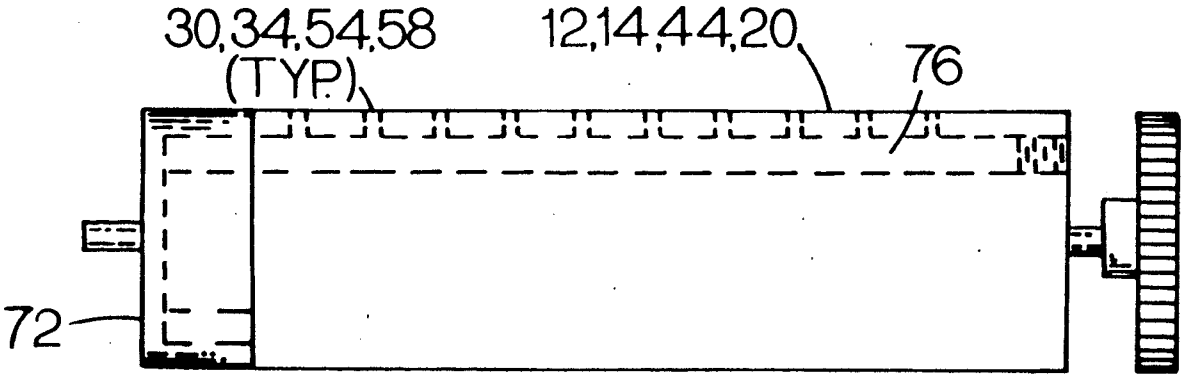

The transfer cylinder 12, the vacuum cylinder 14 the release paper carrier cylinder 44 and the flap fold cylinder 20. The vacuum valve 72 includes a fixed groove 74 and hole provided (e.g., by drilling) within the relative thick wall 78 of each of the cylinders (12, 14, 44, and 20). The holes 30, etc. are drilled through wall 78 (see attached drawing FIG. 4C, 4D, and 4E).

The groove 74 in the vacuum valve 72 is in communication with the longitudinal hole 76 periodically as the respective cylinder rotates. The length of the groove 74 will vary with the extent to which the vacuum is desired for each respective cylinder. As illustrated in FIG. 4B through FIG. 4E, the vacuum is applied to approximately one-half of the holes through the surface of the cylinder or for approximately 180° of cylinder rotation.

The vacuum applied to each of the cylinders (12, 14, 44, and 20). As the cylinders (12, 14, 44, and 20) rotate only the vacuum holes in communication with the respective groove 74 through hole or opening 76 are in communication with a vacuum for holding an envelope 26 securely to the external cylindrical surfaces (28, 32, 52, and 56) of the cylinders (12, 14, 44, and 20).

When not in communication with the vacuum, the envelope 26 will be released from the cylindrical surfaces (28, 32, 52, and 56) for transfer to the receiving cylinders (12, 14, 44, and 20) as they rotate to provide communication between the vacuum holes and the respective hole or slot 76 and groove 74 in respective vacuum valve 72.

An attachment means is provided which is used to attach and support the various components of the sealing assembly attachment 10 to a conventional frame. In one preferred embodiment, incorporated within the attachment means is a means to supply a vacuum to each respective vacuum valve 72.

The means for supplying the vacuum communicates with the fixed vacuum valve 72 and the supporting means for the transfer cylinder 12, vacuum cylinder 14, and flap fold cylinder 20 and release paper carrier cylinder 44 generally consists of shaft 80 and shaft 84 connected to the respective cylinder with a bushing or a bearing 82. This arrangement allows the cylinder to rotate as the vacuum valve remains fixed. A seal (not shown) provided between the vacuum valve and the cylinder maintains the vacuum in the groove 74.

The rotatable shaft 82 has a first component 84 and a second component 86. The first component 84 is solid and associated with an end of each of the cylinders (12, 14, 20 and 44). The second component 86 is associated in the described embodiment with another end of each of the cylinders (12, 14, 20 and 44). The rotatable shaft can be mounted in a bearing 88 on each of the components (84 and 86) about which the rotatable shaft 82 may rotate. The bearing then being mounted as appropriate in a conventional frame.

The rotatable shaft is also attached to the drive means 24 shown schematically in FIG. 5. In one preferred embodiment, there is a gear 90 attached to the rotatable shaft 82. As illustrated, gear 90 is shown attached to the second component 86. However, it will be understood that it could have also been placed on the first component 84.

Typically, the shafts, for example, shaft 80 is a solid shaft having a first end 92 and a second end 94. The first end 92 extends through the vacuum valve and is attached to the cylinder.

The vacuum means (not shown) is a conventional vacuum pump. More then one vacuum pump may be utilized. The pump capacity will be determined by several factors, including but not limited to the number of vacuum holes, the diameter of vacuum holes, the speed of rotation of the cylinders, the size of the envelopes, and the available sizes of conventional vacuum pumps. The vacuum pump is attached to the vacuum valve 72 in an appropriate location relative to the portion of the respective cylinder that requires communication with the vacuum source.

The drive means 24 may consist of a gear train, a belt and pulley system, a chain and gear system or a combination of these system. An electric motor may be supplied to provide rotation motion or the drive means may be attached to the drive mechanism of the entire envelope processing apparatus.

The drive means controls the speed and direction of rotation of the transfer cylinder 12, vacuum cylinder 14, gun pattern application means 16, release paper application means 18, and flap fold cylinder 20. The drive means 24, in the preferred embodiment, comprises a gear train. However, the drive means 24 could be any of the mentioned systems or any other drive means known in the art without departing from the scope and spirit of the invention disclosed herein.

In another embodiment of the present invention, for envelopes generally to large to be effectively rotated on a cylinder, there is provided a belt drive system 100.

In this embodiment, an envelope 110 is transported through the sealing assembly attachment by a pair of belts 112 and 114, instead of a vacuum cylinder. There is typically a top belt 112 and a bottom belt 114. The belts 112, and 114 are typically a continuous belt rotating around end rollers 116. There are at least two end rollers 116 used on each of the belts. One end roller at each end of the belts 112 and 114.

The rollers are mounted in a conventional way by bearings on a frame. The belts are driven by a drive means as described above. The top belt 112 and the bottom belt 114 are mounted such that the outer surfaces of the two belts are in contact for the length of the belts between the end rollers 116. An envelope 110 in this manner can be sandwiched between the two belts to transport the envelope through the sealing assembly attachment 100.

The envelope 110 is fed into the sealing assembly attachment 100 by the conventional envelope processing apparatus. The envelopes 110 are feed into an end of the two belts 112 and 114 between the end rollers 116. The body 120 of the envelope 110 is feed into the sealing assembly attachment with the opening facing upwards and the flap 118 extending completely out of the two belts 112 and 114.

The envelope 110 if first feed through a gum pattern application means 122 to gum the flap 118 on envelope 110. The gum pattern application means 122. in the preferred embodiment, the gum application means 122 comprises a gummer roll apparatus as described above. The gummer roll apparatus being timed to the delivery of an envelope 110 and having a gum application roll 124 for applying the gum to the flap 118 as the envelope 110 is transported through the sealing assembly attachment 100 by belts 112 and 114.

The gum application roll 124 is typically a cylinder having a conventional gummer pad 126. The gummer pad 126 is in the shape of the pattern of the flap 118 on the envelope 110. This provides for a uniform application of gum along the edge of the flap 118. The gum roll apparatus supplies a uniform thickness of gum to the gummer pad 126. In this embodiment an idler cylinder 128 may be utilized under the gum application roll 124 to provide support for the gumming operation as the flap 118 of envelope 110 is being gummed.

A release paper application means 130 is located after the gum pattern application means 122. The release paper application means 130 places a piece of release paper over the gum applied to the flap 118. The release paper application means 130, in the preferred embodiment, generally consists of a release paper carrier cylinder 44, a rotary knife cylinder 46, a stationary knife 48 and a roll of release paper 50, as described above.

The release paper carrier cylinder 44 applies the piece of release paper on the flap 118 as the envelope 118 is transported past the release paper carrier cylinder 44 on the belts 112 and 114 after the flap 118 has been gummed by the gum application means 122.

The release paper carrier cylinder 44 receives the piece of release paper delivered from the rotary knife cylinder 46. The piece of release paper is cut by the stationary knife 48 as the rotary knife cylinder 46 rotates and pulls release paper from the roll of release paper.

The release paper carrier cylinder 44 is a cylinder and having an external cylindrical surface 52 with an arrangement of vacuum holes 54. The vacuum valve and vacuum supply is in communication with the respective vacuum holes as is described above.

The illustrated embodiment includes a take away vacuum cylinder 132 is utilized. The take away vacuum cylinder 132 is used with the release paper application means 130. The take away vacuum cylinder 132 is located below the release paper carrier cylinder 44. The take away vacuum cylinder 132 removes and discards a piece of release paper from the release paper carrier cylinder 44 in case there is a skip or a miss when the envelopes are transported through the sealing assembly attachment 100.

The take away vacuum cylinder 132 is a cylinder with an external cylindrical surface with an arrangement of vacuum holes. The take-away vacuum cylinder 132 includes an a vacuum valve arrangement as described above for transfer cylinder 12, vacuum cylinder 14 release paper carrier cylinder 44 and flap fold cylinder 20.

Figure 1B:
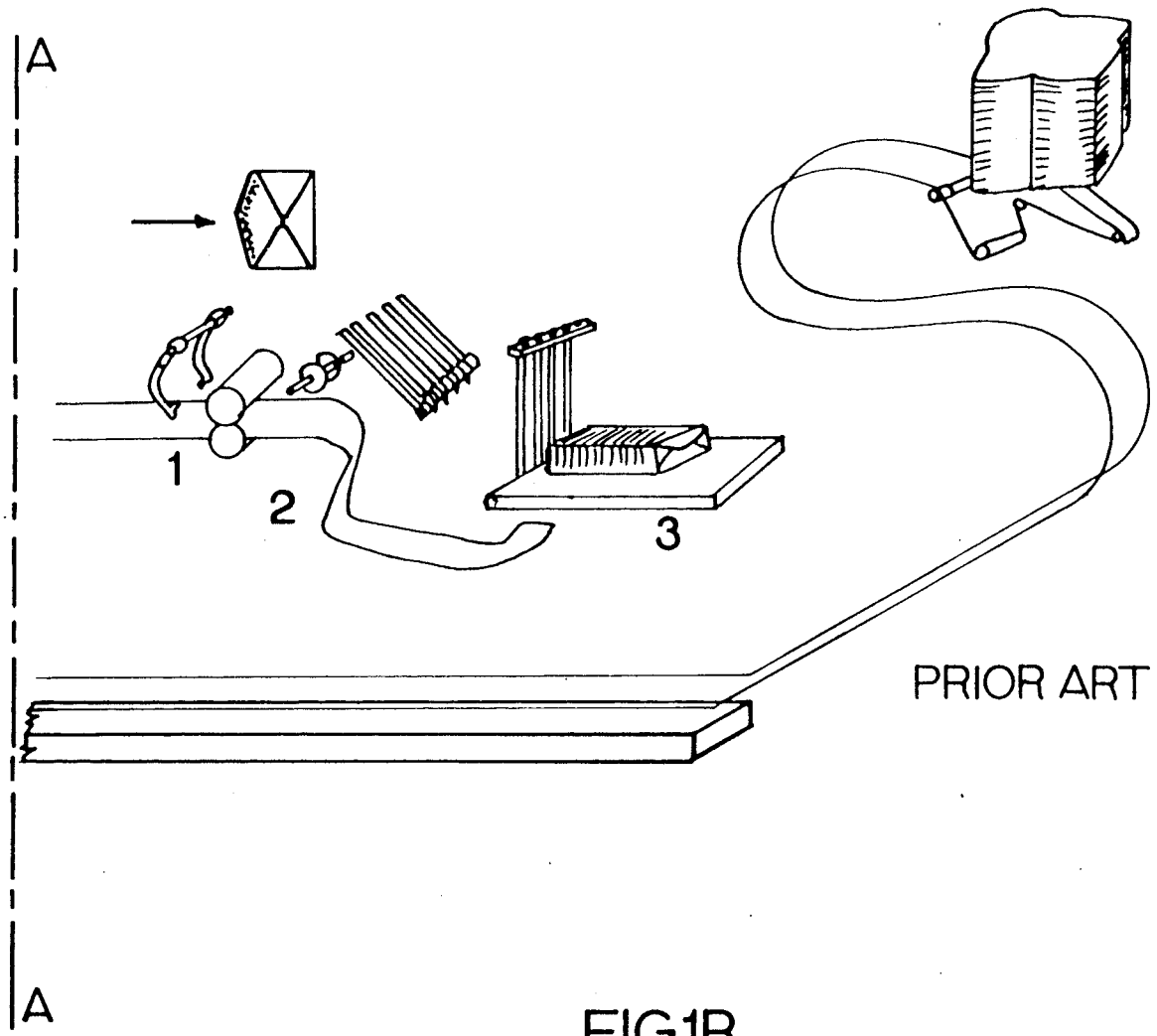

In operation, in connection with the prior art envelope apparatus illustrated in FIGS. 1A and 1B, the first embodiment of the present invention described herein takes the place of steps 1 and 2 in FIG. 1B. Vacuum cylinder 12 picks up the envelope from the folding machine and the table 3 becomes the delivery table 66.

Figure 6:
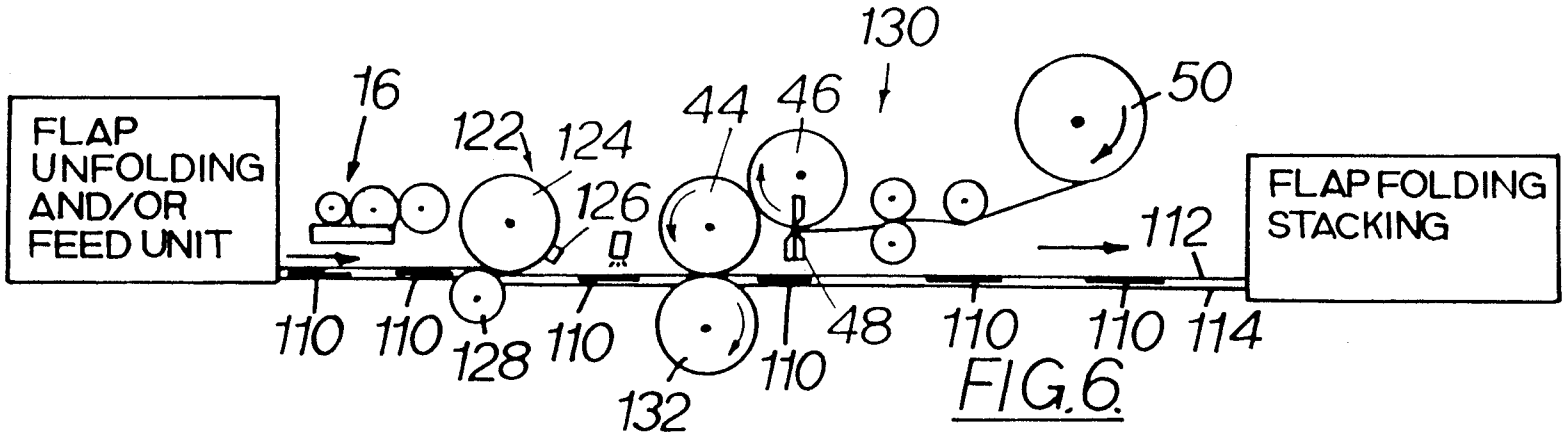
FIG. 6 is a side elevation view showing another embodiment of the invention for use as an add-on attachment to an existing piece of equipment.

In the attachment embodiment there is preferably provided flap unfolding and feed unit as depicted schematically in FIG. 6. As is understood these devices are conventional and can be readily adapted to the present invention by one skilled in the art. The unfolding can be followed with a creaser unit or a compressed air source may be provided to maintain the flap in the unfolded position to receive the release paper patch.

In a preferred embodiment, the gum box arrangement 16 includes a gum pan 200, a roll 202, a dip roll 204, and an applicator roll 206. The gum application roll 40 is approximately 5" in diameter and the delivery discs 60 are approximately 10" in diameter with ten (10) slots. It will be understood to size the other rolls in order to provide the desired registration of the envelopes with the release paper and delivery discs and folding machine. The diameters could be 5", 5 178 ", 6", or 8".

The transfer cylinder 28 and the cylinder 20 may also be 5" or other diameter as determined for desired operation. A vacuum valve has been indicated in the diagram in view of the fact that other vacuum arrangements are possible as will be understood by one skilled in the art. The larger cylinders may have more vacuum holes for two envelope receiving stations where the 5" cylinders would have a single station of vacuum holes for a single envelope.

From the foregoing description those skilled in the art will appreciate that all of the objects of the present invention are realized. A sealing assembly attachment has been shown and described for providing the desired application of an adhesive strip or patch and the application of a patch of release paper over the adhesive to manufacture an envelope that is sealed by removing the release paper patch and pressing the flap (for example) against the envelope, thereby sealing the envelope.

Figure 7:
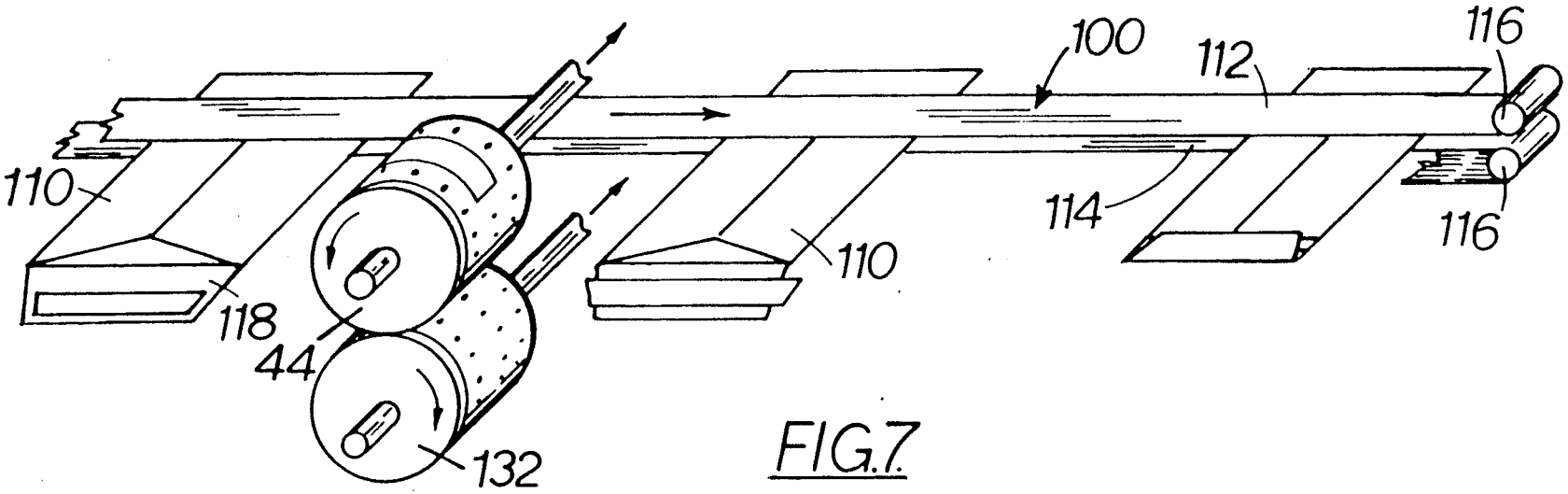
FIG. 7 is a perspective view of an embodiment of the invention showing a particular arrangement of one preferred embodiment and the relationship of some of the components depicted in FIG. 6.

FIGS. 2-5 depict one embodiment of the present invention that is adapted for incorporation into a conventional construction of envelope manufacturing equipment or, as depicted in FIGS. 6 and 7, a separate unit for attachment to another piece of equipment. In both applications the sealing assembly is used to provide for applying one or more adhesive sealing strips to an envelope or envelope flap and then apply one or more release sheets as required over the adhesive sealing strip applied to the envelope.

The sealing assembly attachment and method of the present invention is adapted for gumming a top flap, placing a piece of release paper onto the gummed flap over the applied adhesive, and folding the creased the top flap back over for stacking.

It now will be understood that the present invention may be incorporated into conventional stacking and counting equipment. The stand alone or add-on embodiment of the sealing assembly attachment of this invention can be used as either a stand alone station or incorporated into an existing piece or unit of envelope processing apparatus.

The sealing assembly attachment and method of the present invention provides a more continuous and uniform adhesive transfer and placement of release paper over the gummed flap or flaps. This is due in part because the release paper patch is applied to a moving envelope.

The timing modifications required to ensure that the timing of the gumming and release paper placement operations are properly timed to the existing equipment with the present invention become a matter that can be accomplished by an operator by changing speed or cylinder diameters.

Figure 2:
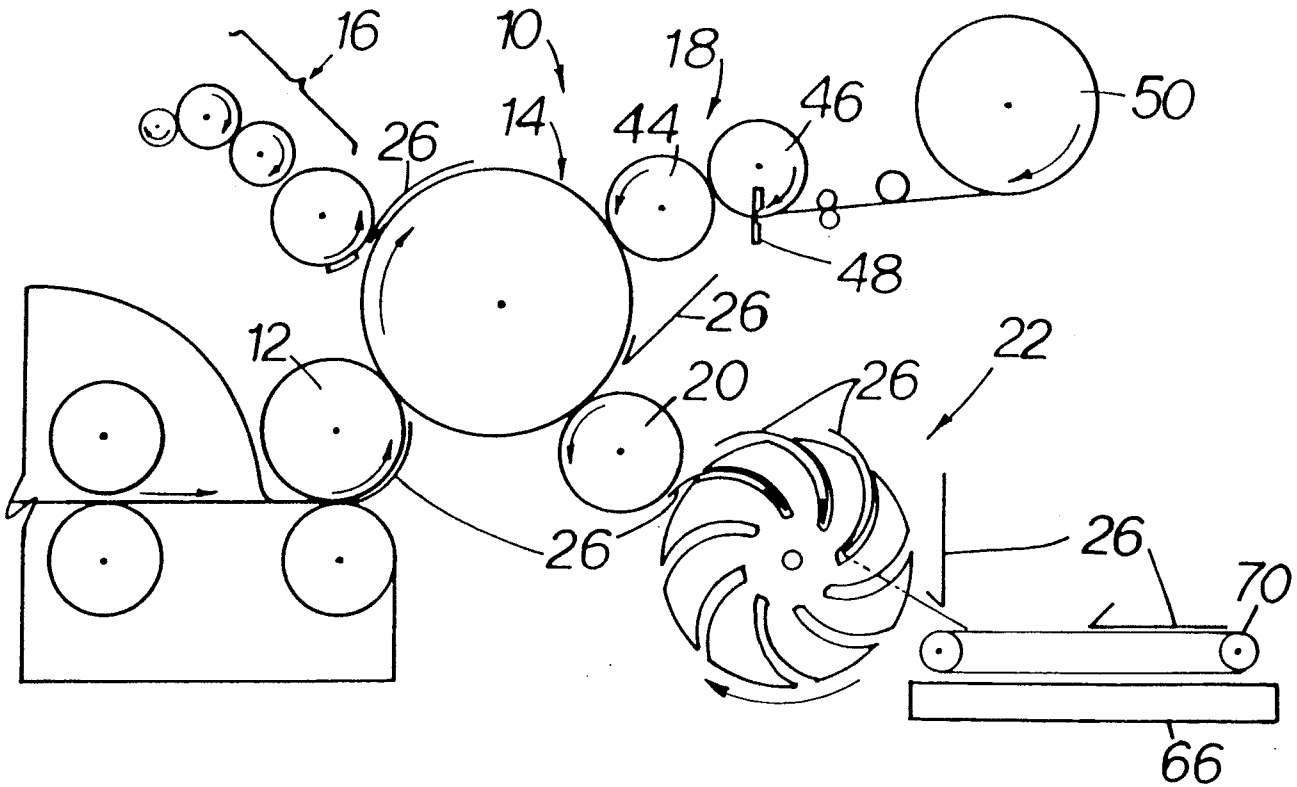
FIG. 2 is a diagram of a preferred embodiment showing one preferred configuration of the components of the present invention.
Figure 3:
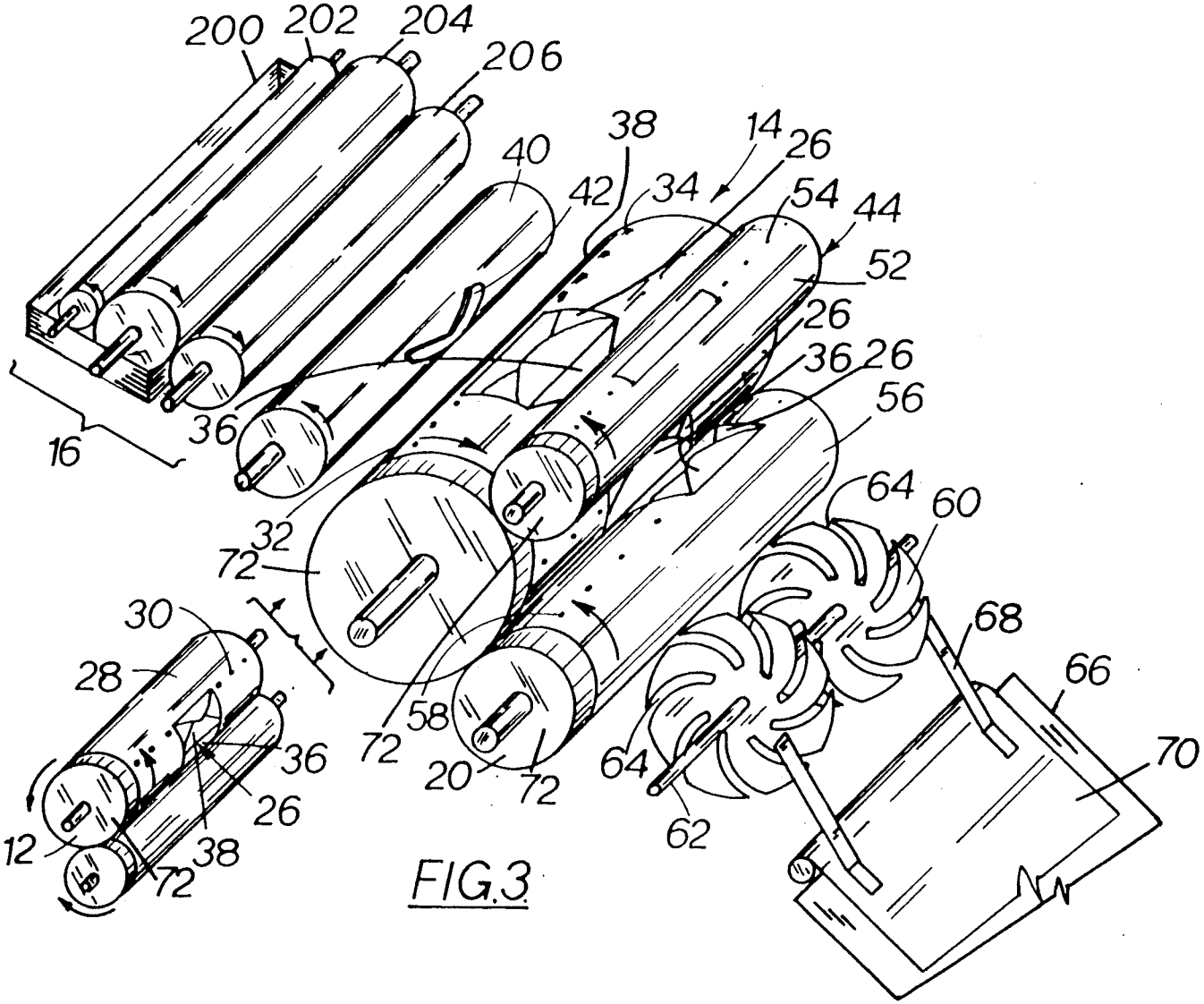
FIG. 3 is a perspective view illustrating the preferred embodiment diagrammed in FIG. 2.
Figure 4A:
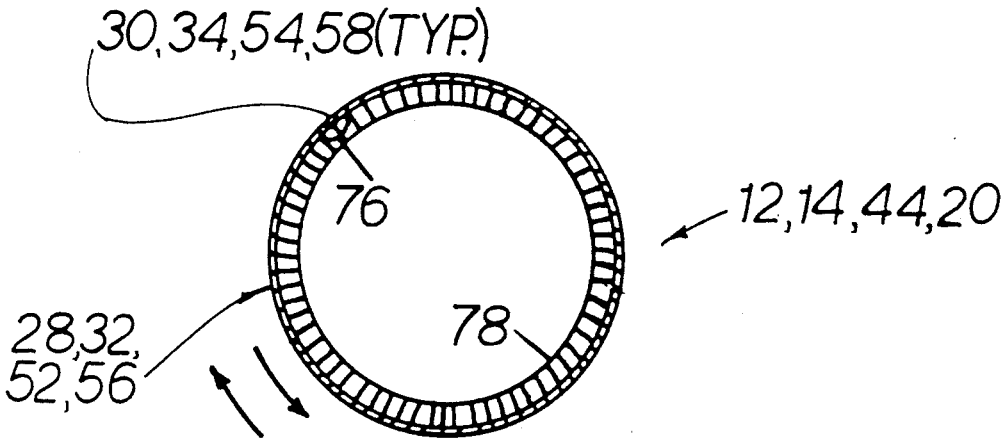
FIG. 4A is a typical side cross-sectional view of a vacuum cylinder representative of the vacuum cylinders incorporated into the present invention and illustrating one preferred arrangement of the communication port between the vacuum valve and the vacuum port or ports in the respective cylinder with only one row of vacuum ports illustrated for purposes of clarity.

The combination of vacuum cylinders can be arranged to provide a sealing assembly and attachment that will fold and crease a top flap once a sheet of release paper is applied over a gummed portion of the flap. One preferred embodiment is illustrated in FIGS. 2 and 3 and another preferred embodiment is illustrated in FIGS. 6 and 7.

While specific embodiments have been shown and described, many variations are possible. However, many of these members and components can be removed and modified, altered or changed to suit a particular application.

Therefore, it will be understood that those skilled in the art have the ability to modify, alter or change the arrangements and the particular configurations herein described without departing from the spirit and scope of this invention. This may include but not limited to the drive means, transport means, gum application means, release paper application means and the delivery means.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A sealing assembly attachment, for use in preparing envelopes which will apply a gum to a top flap, place a piece of release paper over the gummed flap, fold and crease the top flap and deliver the envelope to be stacked and counted, comprising:

a transfer cylinder to transfer envelopes into the sealing assembly attachment;

a vacuum cylinder within the sealing assembly attachment to transfer envelopes from the transfer cylinder and through the sealing assembly attachment;

a gum pattern application means to apply gum to a top flap of the envelopes while being transferred by the vacuum cylinder;

a release paper application means after the gum pattern application means to place release paper over the gum applied to the top flap;

a flap fold cylinder in cooperation with the vacuum cylinder to fold and crease the top flap; and a delivery means to transfer the envelope from the sealing assembly attachment.

2. A sealing assembly attachment as set forth in claim 1 further comprising a drive means, the drive means controlling speed and direction of rotation of the transfer cylinder, vacuum cylinder, gun pattern application means, release paper application means, and flap fold cylinder.

3. A sealing assembly attachment as set forth in claim 1 in which each of the transfer cylinder, vacuum cylinder and flap fold cylinder comprise cylinders and each having an external cylindrical surface with an arrangement of vacuum holes, the vacuum holes attracting and holding an envelope to the cylindrical surface of cylinder as the cylinder rotates, a vacuum valve arrangement providing the desired communicating between the vacuum holes and a vacuum source.

4. A sealing assembly attachment as set forth in claim 3 in which the means for attaching a vacuum means and the supporting means comprises a fixed shaft and a rotatable shaft, the rotatable shaft having a first and a second component, the first component being solid and attached to the center of one end of each of the cylinders, the second component attached to the center of the other end of each of the cylinders, the rotatable shaft containing a bearing on each of the components about which the rotatable shaft may rotate, the rotatable shaft being attached to the drive means, and the fixed shaft having a first end extending through the second component of the rotatable shaft into the cylinders.

5. A sealing assembly attachment as set forth in claim 3 in which the vacuum valve includes an internal groove and the cylinder includes a longitudinal opening through the cylinder wall in communication with the vacuum holes, a vacuum being applied to the vacuum holes such that as the cylinders rotate only the vacuum holes in communicating with the groove in the vacuum valve are supplied with a vacuum for holding an envelope securely to the external cylindrical surface of the cylinders.

6. A sealing assembly attachment as set forth in claim 1 in which the gum application mean comprises a gummer roll apparatus, the gummer roll apparatus being timed to the delivery of an envelope and having a gum application roll for applying gum to a flap of the envelope as the envelope rotates on the vacuum cylinder.

7. A sealing assembly attachment as set forth in claim 1 in which the release paper application means comprises a release paper carrier cylinder, a rotary knife cylinder, a stationary knife and a roll of release paper, the release paper carrier applying a piece of release paper on a flap of an envelope as the envelope rotates past the release paper carrier cylinder on the vacuum cylinder after the flap has been gummed by the gum application means, the release paper carrier cylinder receiving a piece of release paper delivered from the rotary knife cylinder, the piece of release paper being cut by the stationary knife as the rotary knife cylinder rotates and pulls release paper from the roll of release paper.

8. A sealing assembly attachment as set forth in claim 7 in which the release paper carrier cylinder comprises a cylinder and having an external cylindrical surface with an arrangement of vacuum holes, the vacuum holes attracting and holding the piece of release paper to the cylindrical surface of the release paper carrier cylinder as the cylinder rotates, an associated vacuum valve for controlling the application of vacuum to the vacuum holes.

9. A sealing assembly attachment as set forth in claim 1 in which the delivery means comprises delivery disks, the delivery disks being rotatable and having spiral slots for receiving completed envelopes from the flap fold cylinder and delivering the completed envelopes to a delivery table.

10. A sealing assembly attachment, for use in preparing envelopes which will apply a gum to a top flap, place a piece of release paper over the gummed flap, fold and crease the top flap and deliver the envelope to be stacked and counted, comprising:

a transfer cylinder to transfer envelopes into the sealing assembly attachment, the transfer cylinder being a cylinder and having a cylindrical surface with an arrangement of vacuum holes, the vacuum holes attracting and holding an envelope to the cylindrical surface of the transfer cylinder as the transfer cylinder rotates, an vacuum valve controlling the application of the vacuum to the respective vacuum holes;

a vacuum cylinder within the sealing assembly attachment to transfer envelopes from the transfer cylinder and through the sealing assembly attachment, the vacuum cylinder being a cylinder and having a cylindrical surface with an arrangement of vacuum holes, the vacuum holes attracting and holding an envelope to the cylindrical surface of the vacuum cylinder as the vacuum cylinder rotates relative to the vacuum valve;

a gum pattern application means to apply gum to a top flap of the envelopes while being transferred by the vacuum cylinder;

a release paper application means after the gum pattern application means to place release paper over the gum applied to the top flap;

a flap fold cylinder in cooperation with the vacuum cylinder to fold and crease the top flap, the flap fold cylinder being a cylinder and having a cylindrical surface with an arrangement of vacuum holes, the vacuum holes attracting and holding an envelope to the cylindrical surface of the flap fold cylinder as the flap fold cylinder rotates relative to the vacuum valve;

a delivery means to transfer the envelope from the sealing assembly attachment; and a drive means, the drive means controlling speed and direction of rotation of the transfer cylinder, vacuum cylinder, gun pattern application means, release paper application means, and flap fold cylinder.

11. A sealing assembly attachment as set forth in claim 10 in which the means for attaching a vacuum and the supporting means for the transfer cylinder, vacuum cylinder, and flap fold cylinder comprises a fixed shaft and a rotatable shaft, the rotatable shaft having a first and a second component, the first component being solid and attached to the center of one end of each of the cylinders, the second component being attached to the center of the other end of each of the cylinders, the rotatable shaft containing a bearing on each of the components about which the rotatable shaft may rotate, the rotatable shaft being attached to the drive means, and the fixed shaft having a first end extending through the second component of the rotatable shaft into the cylinders, the vacuum valve fixed relative to the respective cylinder and connected to a vacuum means for providing a vacuum in each of the cylinders.

12. A sealing assembly attachment as set forth in claim 10 in which the vacuum valve includes a groove in communication with the respective vacuum holes of each of the cylinders.

13. A sealing assembly attachment as set forth in claim 10 in which the gum application mean comprises a gummer roll apparatus, the gummer roll apparatus being timed to the delivery of an envelope and having a gum application roll for applying gum to a flap of the envelope as the envelope rotates on the vacuum cylinder.

14. A sealing assembly attachment as set forth in claim 13 in which the gummer roll apparatus is connected to and driven by the drive means.

15. A sealing assembly attachment as set forth in claim 10 in which the release paper application means comprises a release paper carrier cylinder, a rotary knife cylinder, a stationary knife and a roll of release paper, the release paper carrier applying a piece of release paper on a flap of an envelope as the envelope rotates past the release paper carrier cylinder on the vacuum cylinder after the flap has been gummed by the gum application means, the release paper carrier cylinder receiving a piece of release paper delivered from the rotary knife cylinder, the piece of release paper being cut by the stationary knife as the rotary knife cylinder rotates and pulls release paper from the roll of release paper.

16. A sealing assembly attachment as set forth in claim 15 in which the release paper carrier cylinder comprises a cylinder and having an external cylindrical surface with an arrangement of vacuum holes, the vacuum holes attracting and holding the piece of release paper to the cylindrical surface of the release paper carrier cylinder as the cylinder rotates, a vacuum valve provided for controlling a vacuum provided the vacuum holes.

17. A sealing assembly attachment as set forth in claim 10 in which the delivery means comprises delivery disks, the delivery disks being rotatable and having spiral slots for receiving completed envelopes from the flap fold cylinder and delivering the completed envelopes to a delivery table.

18. A sealing assembly attachment as set forth in claim 17 in which the delivery disks are attached to a counting means in which the completed envelopes are counted prior to stacking on the delivery table.

19. A sealing assembly attachment as set forth in claim 10 in which the drive means comprises a gear train, the gears controlling rotation direction and speed of the cylinders of the sealing assembly attachment.

20. A sealing assembly attachment as set forth in claim 10 in which the drive means further includes an electric motor to provide rotation motion.

21. A sealing assembly attachment as set forth in claim 10 in which the drive means is connected to a drive mechanism which drive an entire envelope processing apparatus.

22. A sealing assembly attachment as set forth in claim 10 in which the drive means comprises a chain and gear assembly to provide rotational speed and direction control.

23. A method for preparing envelopes which will apply a gum to a top flap, place a piece of release paper over the gummed flap, fold and crease the top flap and deliver the envelope to be stacked and counted, comprising:

transferring envelopes into a sealing assembly attachment by use of a transfer cylinder;

transporting envelopes from the transfer cylinder and through the sealing assembly attachment with a vacuum cylinder;

applying gum to a top flap of the envelopes while being transported by the vacuum cylinder with a gum application means;

applying release paper to the gummed flap of the envelope after the gum application means with a release paper application means;

folding and creasing the top flap of the envelope with a flap fold cylinder in cooperation with the vacuum cylinder; and transferring the envelope from the sealing assembly attachment with a delivery means.

24. A method of preparing envelopes as set forth in claim 23 further comprising:

making each of the transfer cylinder, vacuum cylinder and flap fold cylinder with each having an external cylindrical surface;

arranging a series of vacuum holes on the cylindrical surfaces;

attracting and holding an envelope to the cylindrical surface with the vacuum holes as the cylinder rotates;

providing a means for controlling a vacuum within the cylinder;

attaching a vacuum means to the controlling means; and supporting the cylinder with a supporting means.

25. A method of preparing envelopes as set forth in claim 23 in which the means for attaching a vacuum means and the supporting means further comprises:

providing a rotatable shaft, the rotatable shaft having a first and a second component;

attaching the first component to the center of one end of each of the cylinders;

attaching the second component to the center of the other end of each of the cylinders;

containing a bearing on each of the components to support the cylinder about which the rotatable shaft may rotate;

attaching the rotatable shaft to the drive means;

providing a fixed shaft, the fixed shaft having a first and second end;

extending the first end through the second component of the rotatable shaft into the hollow cylinders;

connecting the second end of the fixed shaft to a vacuum means for providing a vacuum in each of the cylinders; and attaching the first end of the fixed shaft to the vacuum control means.

26. A method of preparing envelopes as set forth in claim 23 in which the vacuum control means comprises a stationary groove relative the associated vacuum holes.

* * * * *